US006477991B2

(12) United States Patent
Möller et al.

(10) Patent No.: US 6,477,991 B2
(45) Date of Patent: Nov. 12, 2002

(54) CRANKCASE WITH INTEGRATED EXHAUST CHAMBERS

(75) Inventors: Heribert Möller, Sachsen; Josef Winter, Rednitzhembach, both of (DE)

(73) Assignee: MAN Nutzfahrzeuge AG (DE)

( * ) Notice: Subject to any disclaimer, the term of this patent is extended or adjusted under 35 U.S.C. 154(b) by 0 days.

(21) Appl. No.: 09/861,135

(22) Filed: May 17, 2001

(65) Prior Publication Data

US 2001/0050064 A1 Dec. 13, 2001

(30) Foreign Application Priority Data

May 17, 2000 (DE) ..... 100 24 218

(51) Int. Cl.[7] ..... F02B 33/04
(52) U.S. Cl. ..... 123/73 PP; 123/572
(58) Field of Search ..... 123/73 PP, 65 PE, 123/196 R, 196 CP, 196 M, 572, 41.86

(56) References Cited

U.S. PATENT DOCUMENTS 6,345,614 B1 * 2/2002 Shureb ..... 123/572

FOREIGN PATENT DOCUMENTS

DE 19736040 2/1999

* cited by examiner

*Primary Examiner*—Tony M. Argenbright
*Assistant Examiner*—Katrina B. Harris
(74) *Attorney, Agent, or Firm*—R W Becker & Associates; R W Becker

(57) ABSTRACT

A crankcase with integrated exhaust chambers and crank chambers partitioned from one another by partitions is provided and includes a plurality of cylinder liners and a plurality of bores each for receiving therein one of the cylinder liners. The crankcase also includes plenum chambers extending lengthwise on both sides of the crankcase for passage thereinto of the blow by and a plurality of bands each for partitioning off the plenum chambers relative to a respective crank chamber in cooperation with the cylinder liners. Window openings in the partition walls and transition passages associated with a respective one of the plenum chambers effect the connection of the crank chambers with the plenum chambers.

2 Claims, 4 Drawing Sheets

CRANKCASE WITH INTEGRATED EXHAUST CHAMBERS

BACKGROUND OF THE INVENTION

The present invention relates to a crankcase with integrated exhaust chambers.

In connection with the evacuation of oil by blow by, it is known from DE 197 36 040 A1 to place plenum chambers in communication with the oil evacuator in order to achieve a pre-evacuation of the largest drops of oil. Two plenum chambers are provided for this pre-evacuation step, each of which extends on a respective opposite side of the cylinder bores over the entire length of the crankcase. These plenum chambers are communicated via bores with the crank chamber. An evacuation arrangement of this type has serious disadvantages with respect to the technical aspects of manufacturing such an arrangement. A multitude of casting core hole covers are required on the side walls of the crankcase for removing the casting sand used for the manufacturing of the plenum chambers.

SUMMARY OF THE INVENTION

The present invention provides a solution to the challenge of manufacturing the above-noted type of plenum chambers in a manner which is advantageous from the point of view of casting of the plenum chambers.

In view of the fact that there is ready access to the side plenum chambers via the bore for the sleeve or cylinder liner, the casting core for casting the plenum chambers can be configured as an integral piece with the crank chamber casting core and the casting sand can be easily removed. Casting core hole covers in the side walls of the crankcase can be completely dispensed with.

The integral configuration of the casting cores as a single unit ensures an efficient manufacturing of the crankcase.

BRIEF DESCRIPTION OF THE DRAWINGS

This object, and other objects and advantages of the present invention, will appear more clearly from the following specification in conjunction with the accompanying schematic drawings, in which:

FIG. 4 is a top sectional view, along line IV—IV, with a view of the flow path of the blow by.

DESCRIPTION OF THE PREFERRED EMBODIMENT

Figure 1:
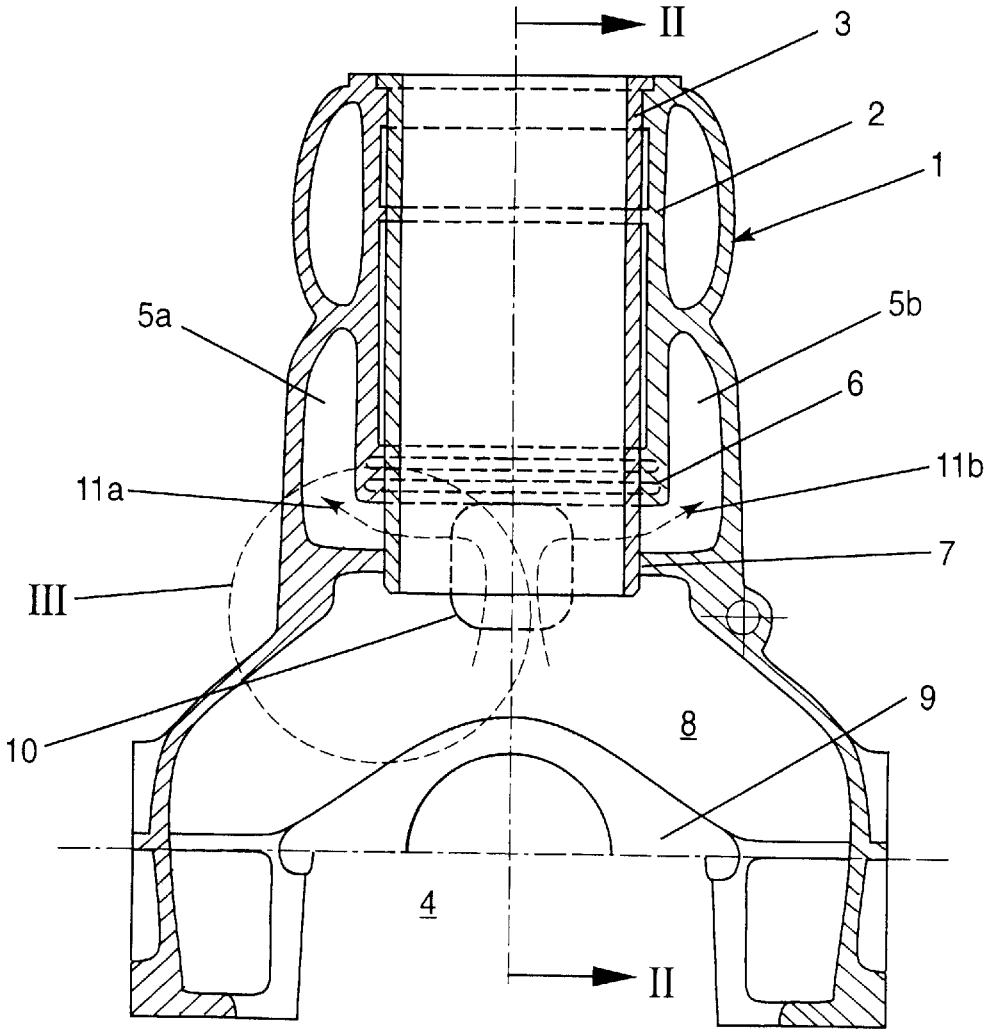
FIG. 1 is a sectional view, along line I—I, of a crankcase with plenum chambers and a window opening in a compartment wall.

FIG. 1 is a sectional view of a crankcase 1 having a bore 2 for the receipt therein of a wet cylinder liner 3. Plenum chambers 5*a*, 5*b* are provided on both sides of the crankcase 1 for receipt and containment of the large scale volume evacuation of oil from the crank chamber 4 effected by the blow by. The bore 2 includes screw threads or taps 6 for receiving thereon sealing rings for sealing off the bore from the cooling fluid, these sealing rings taking over the sealing function relative to the cooling fluid after the installation of the cylinder liners. The crankcase 1 further includes, under the threads 6, a band or collar 7 which effects the sealing off of the crank chamber 4 relative to large scale volume penetration of the injected oil. The compartmentalization or partitioning of the crank chambers 4 one from another is effected by the compartment walls 8 combined with the bearing block 9.

Each crank chamber 4 is, in accordance with the present invention, connected with the plenum chambers 5*a*, 5*b* via a window opening 10 in the compartment wall 8 and the two transition passages 11*a* and 11*b* on both sides. The blow by passes via the window opening 10, which opens into the crank chamber 4, and thereafter via the transition passages 11*a* and 11*b*, into the plenum chambers 5*a*, 5*b*, as is shown by the paths represented by the broken lines and the arrows. The blow by likewise passes over the portion disposed under the cylinder liner 3, as will now be described with reference to FIGS. 3 and 4.

The particular advantage of this oil evacuation arrangement can be seen in the efficient manufacturing approach which is made possible by the arrangement. The casting core for the crank chamber 4 and the plenum chambers 5*a*, 5*b* can be manufactured as a single piece. The interconnection of the casting core for the crank chamber 4 and the plenum chambers 5*a*, 5*b* is effected by the casting core s for the window opening 10 and the transition passages 11*a*, 11*b*. The sections of the casting core for the plenum chambers 5*a*, 5*b* can be easily removed following a successfully completed cast.

Figure 2:
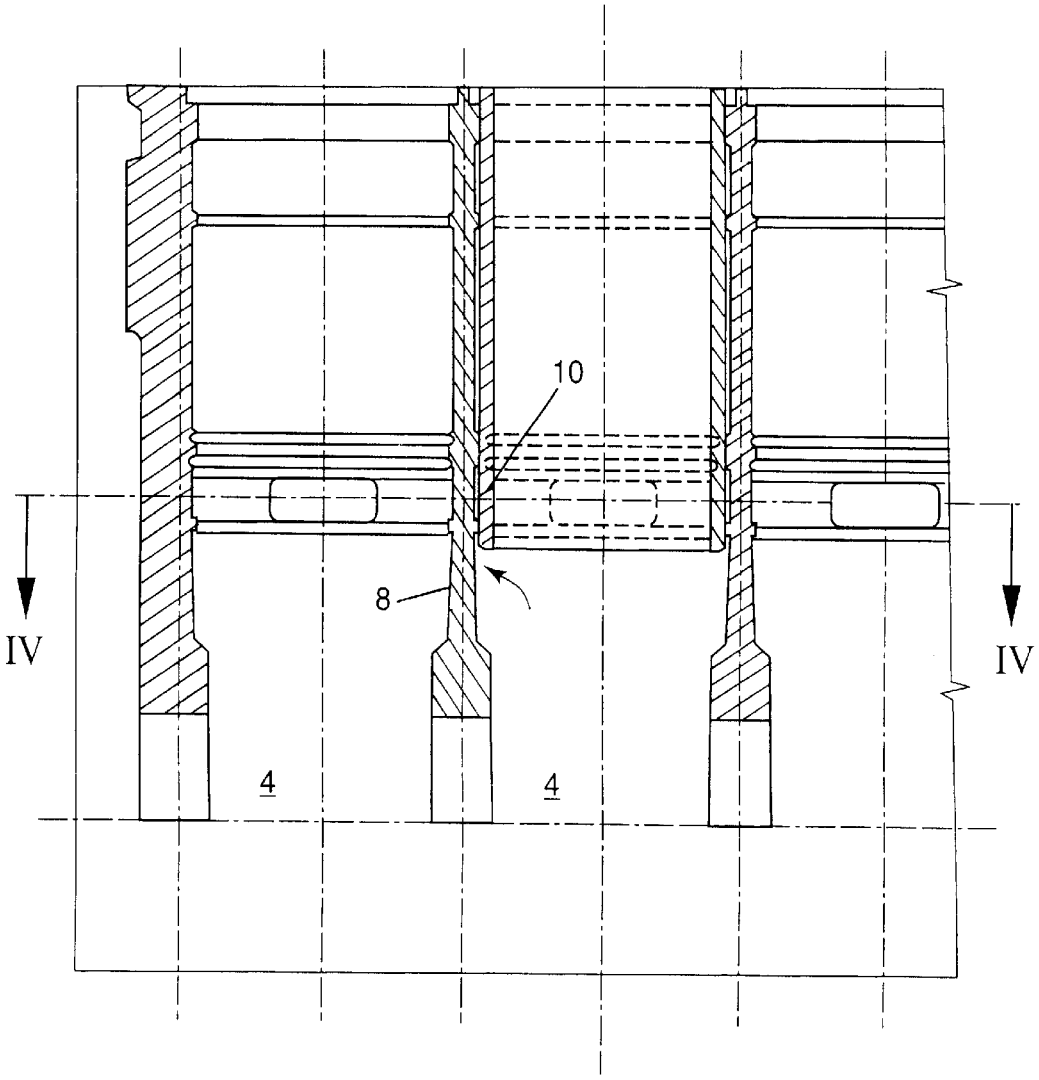
FIG. 2 is a lengthwise sectional view, along line II—II, of the crankcase with the window opening in the compartment wall.

FIG. 2 is a lengthwise sectional view along line II—II of the crankcase 1. The compartment wall 8, which separates the crank chambers 4, comprises the window openings 10, opening into the crank chambers 4, through which the blow by enters, as indicated by the arrows.

Figure 3:
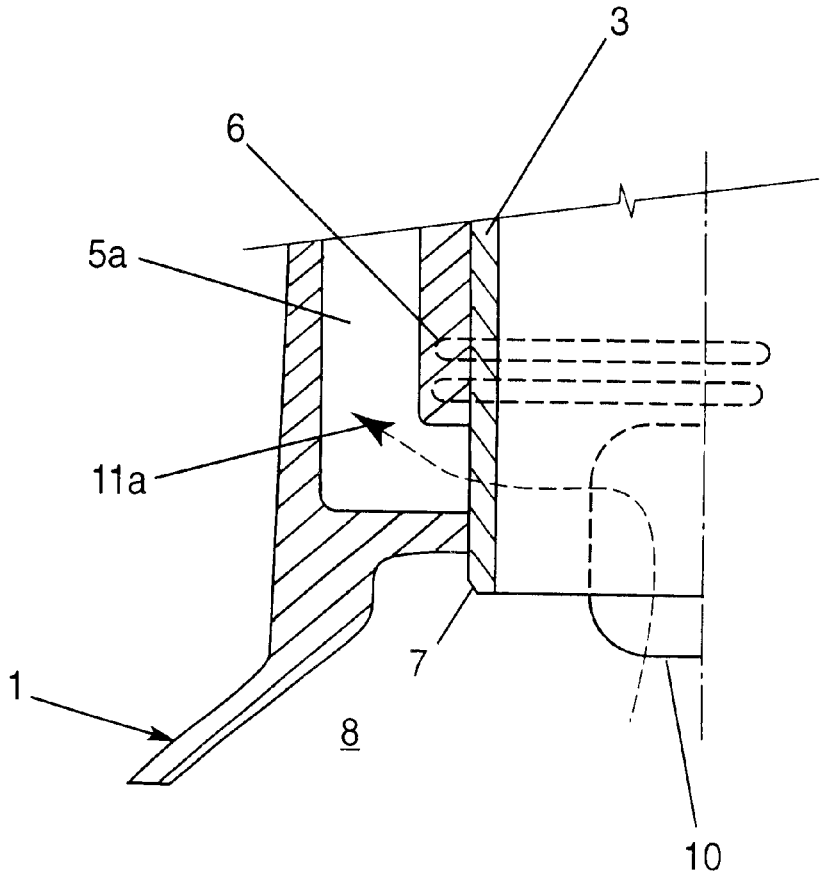
FIG. 3 is a sectional view, along line III—III, showing details of the window opening and the transition passages to a plenum chamber.

FIG. 3 shows, in a midsection view, the details of the path of the blow by. The cylinder liner 3 is sealed off relative to the cooling fluids by the sealing rings disposed on the grooves 6. A sealing off of the crank chamber 4 against large scale volume fluid penetration is effected by the band 7 and the cylinder liner 3. The compartment wall 8 comprises the window openings 10, opening into the crank chamber 4, through which the blow by enters, as representatively shown by the arrows, and proceeds thereafter through the transition passages 11*a* to the plenum chamber 5*a*, which extends in the interior of the crankcase along the lengthwise extent thereof. The blow by flows, as shown by a broken line, through a space delimited by the cylinder liner 3 and the walls of the transition passage 11*a*.

Figure 4:
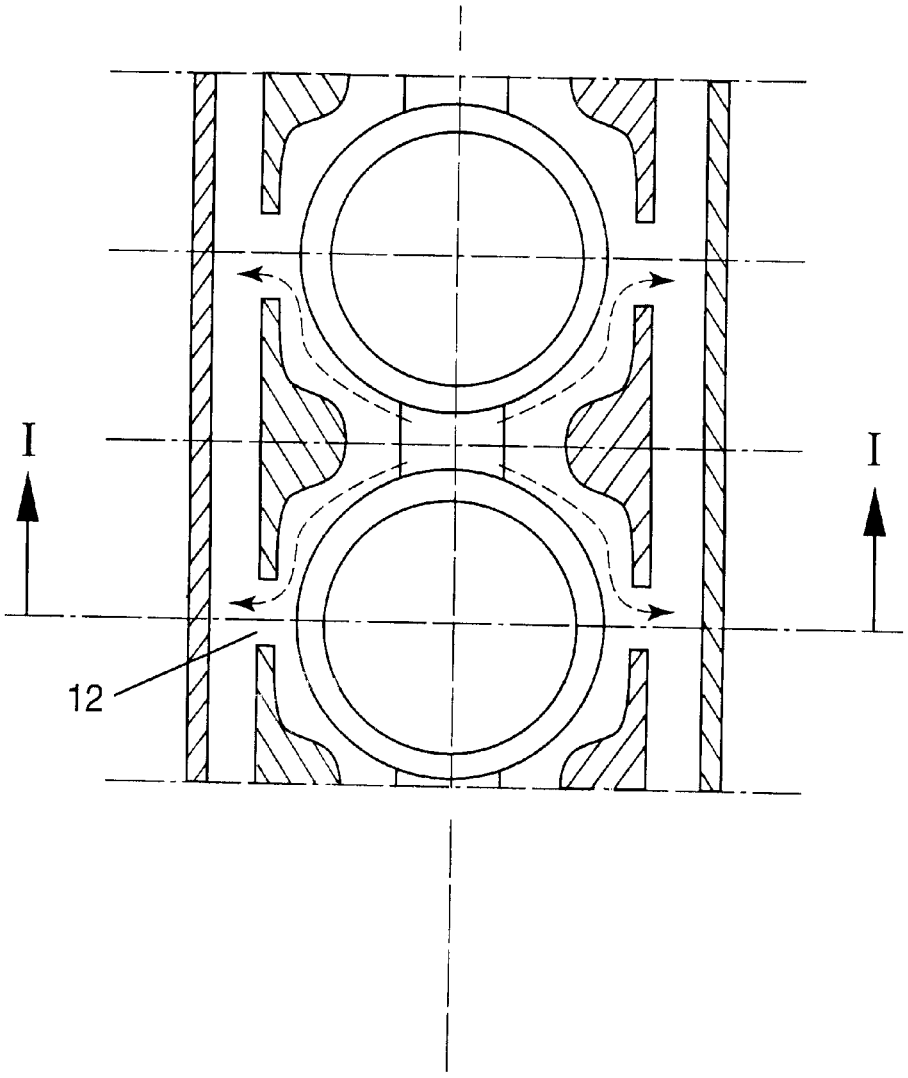

FIG. 4 shows a top sectional view of the cylinder liners 3 with the window openings 10 and the transition passages 11*a*, 11*b*. The casting sand for casting the transition passages 11*a*, 11*b* (FIG. 1) can be removed via the openings 12 following the casting operation so that openings in the side walls of the crankcase 1 can be dispensed with.

The specification incorporates by reference the disclosure of German priority document 100 24 218.9 of May 17, 2000.

The present invention is, of course, in no way restricted to the specific disclosure of the specification and drawings, but also encompasses any modifications within the scope of the appended claims.

What we claim is:

1. A crankcase with integrated exhaust chambers and crank chambers partitioned from one another by partitions, the crankcase comprising:

a plurality of cylinder liners;

a plurality of bores each for receiving therein one of the cylinder liners, the bores including grooves for sealing off the cylinder liners relative to the penetration of cooling fluid and the crankcase;

plenum chambers extending lengthwise on both sides of the crankcase for passage thereinto of the blow by;

a plurality of bands each for partitioning off the plenum chambers relative to a respective crank chamber in cooperation with the cylinder liner;

window openings in the partition walls; and respective pairs of transition passages, each transition passage of a respective pair of transition passages being associated with a respective one of the plenum chambers, whereby the connection of the crank chambers with the plenum chambers is effected via the window openings which are open into the crank chambers and in communication with the plenum chambers via transition passages at the cylinder liners.

2. A crankcase according to claim 1, wherein casting cores for the plenum chambers and the crank chambers together form an integral unit and the interconnection of these casting cores to one another is effected by casting cores for the window opening and the transition passages.

* * * * *